US005330144A

United States Patent [19]

Stevenson et al.

[11] Patent Number: 5,330,144

[45] Date of Patent: Jul. 19, 1994

[54] FRAME STRUCTURE AND ASSEMBLY FOR WALL MOUNTING A SPEAKER OR CAMERA

[75] Inventors: Bruce B. Stevenson; Paul T. Scherer; Bill R. Unseld; James W. Dickens, all of Lexington, Ky.

[73] Assignee: Square D Company, Palatine, Ill.

[21] Appl. No.: 1,968

[22] Filed: Jan. 8, 1993

[51] Int. Cl.[5] ..... A47F 5/08

[52] U.S. Cl. ..... 248/231.9; 248/903

[58] Field of Search ..... 248/231.9, 906, 27.1, 248/205.1, 903; 220/3.5, 3.6, 241; 174/58

[56] References Cited

U.S. PATENT DOCUMENTS

| | | | |
|---|---|---|---|
| 4,685,035 | 8/1987 | Nanjoh | 174/58 X |
| 5,178,350 | 1/1993 | Vink et al. | 248/906 X |
| 5,221,069 | 6/1993 | Struthers et al. | 248/231.9 |
| 5,221,814 | 6/1993 | Colbaught et al. | 174/58 X |

*Primary Examiner*—Ramon O. Ramirez

*Attorney, Agent, or Firm*—Larry I. Golden; Kareem M. Irfan

[57] ABSTRACT

The invention provides a mounting frame structure for association with a preformed aperture in a wall and for recessed mounting of a speaker or camera having a housing. The frame structure includes a one-piece, unitary frame body having an open central region for receiving therethrough body portions of the housing. The frame body has a flattened perimeter region and apertures individually located in the perimeter region. The frame structure also includes a shoulder region upstanding rearwardly from and extending substantially about the perimeter region. A mounting flange upstands rearwardly in a perpendicular direction from the perimeter region. The mounting flange has a generally flat shape and at least one aperture therethrough so that the mounting flange abuts and secures to a stud or cross-member of the wall. Optionally, the frame structure is utilized in an assembly with a mounting bracket for the camera or speaker and a cover plate thereover.

36 Claims, 3 Drawing Sheets 10
42
44
40
34
76
36
20
94
96
38
92
64
72
60
66
62
28
50
46
36
30
26
18
48
90
56
64
74
84
84
86
16
22
88
98
52
68
90
106
70
54
80
78
82
100
24
76
104

110
140
142
144
132
134
196
192
194
120
138
128
136
130
126
118
181
183
158
150
146
156
190
198
116
124
122
148
160
152
154
206
205
202
200
204

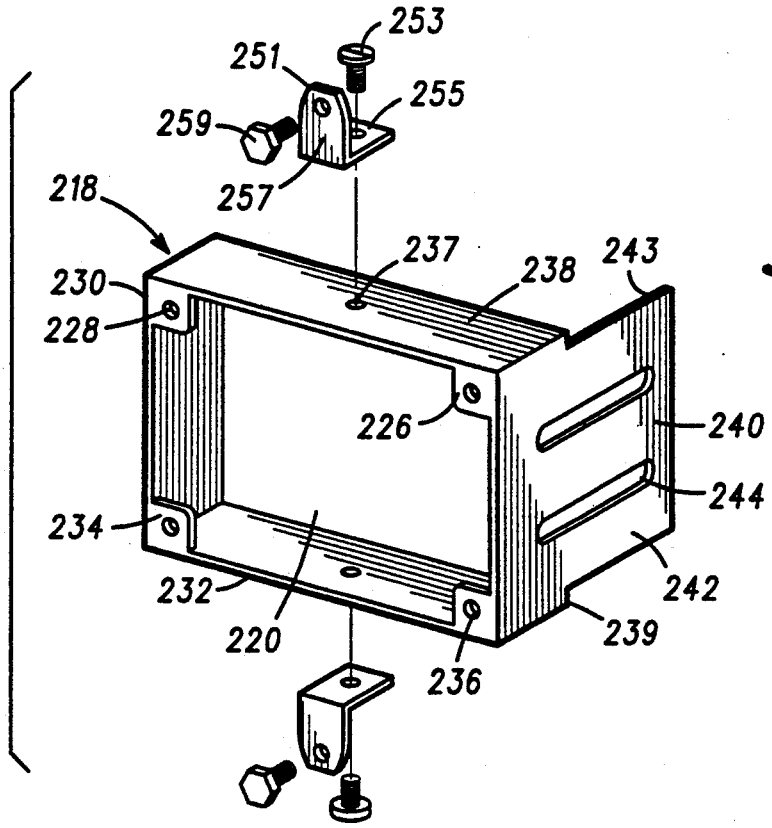
Fig. 3
Fig. 4
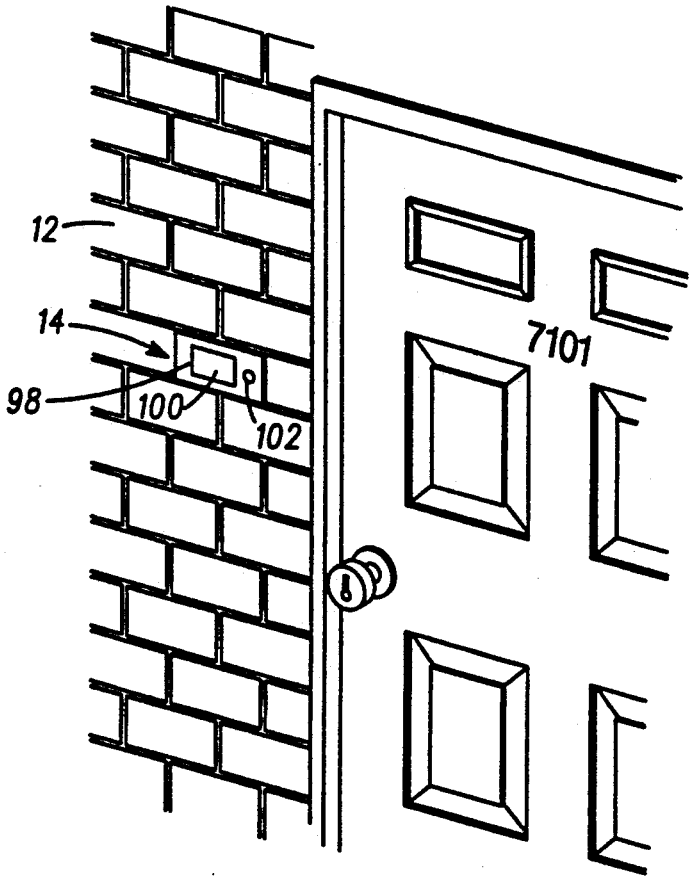

FRAME STRUCTURE AND ASSEMBLY FOR WALL MOUNTING A SPEAKER OR CAMERA

FIELD OF THE INVENTION

The present invention relates to an improved frame structure and optional mounting assembly for recessed mounting of a speaker or camera in a wall or the like.

BACKGROUND OF THE INVENTION

There is a growing demand for increased security in various markets. Part of providing such security is the need to control access through exterior doors for homes and multiple unit residential installations and with both exterior and interior doors in commercial and industrial complexes. Access is often controlled by security cameras which monitor the doorway and other sensitive areas. Speakers and microphones are also needed to provide communication between security and persons gaining entrance.

In the prior art there are speaker support frame structures of varying design. Many of these designs fail to take into account the problems of installing the housing of a speaker or camera in the desired application.

Preferably, the frame structure is independently engaged or disengaged with either the wall or, the housing of a speaker or camera. Optionally, the frame structure is part of an assembly for mounting a speaker or camera which also includes a cover plate. To be versatile in its application, the assembly must have a configuration which is strong and yet, for aesthetic reasons, not overly bulky. The configuration should also lend itself to installations providing convenient access to users. The present invention provides such an improved support frame structure and optional assembly.

SUMMARY OF THE INVENTION

Accordingly, the present invention provides a mounting frame structure for association with a preformed aperture in a wall and for recessed mounting of a speaker or camera having a housing. The frame structure includes a one-piece, unitary frame body having a front and back side. The frame body has an open central region for receiving therethrough body portions of the housing. The frame body has a flattened perimeter region extending about the open central region. A plurality of apertures are provided that are individually located in the perimeter region at periodically spaced intervals about and adjacent to the open region.

The frame structure also includes a shoulder region upstanding rearwardly from and extending substantially about the perimeter region. The shoulder region having an inner and outer face. The inner face of the shoulder region is adjacent to the housing.

The frame structure includes a mounting flange which upstands rearwardly in a perpendicular direction from the perimeter region. The mounting flange has a generally flat shape and at least one aperture therethrough so that the mounting flange abuts and secures to a stud or cross-member of the wall.

The present invention also provides for an assembly which includes the frame structure described above as well as a mounting bracket and cover plate. The mounting bracket inserts into the frame structure and attaches directly to the camera or the speaker housing. The mounting bracket has a front and back side with an open central region for receiving therethrough body portions of the housing.

The mounting bracket includes a flattened perimeter region extending about the open central region with the back side adapted for making abutting engagement with the front side of the frame body. A plurality of apertures are individually located in the bracket perimeter region at periodically spaced intervals about and adjacent to the bracket central region. The apertures of the frame body and bracket perimeter region are adapted to disengagedly connect with one another so that the back side of the bracket perimeter region mounts against the front face of the frame body perimeter region. A shoulder region upstands rearwardly from and extends substantially about the perimeter region. The shoulder region is adjacent to the housing. Means for securing the housing to the mounting bracket at the desired angle are also included.

The cover plate substantially covers the mounting bracket and frame structure to provide an aesthetically pleasing flush mount with the wall. The cover plate attaches to the mounting bracket with fastening means therebetween.

An object of the present invention is to provide a frame structure which can be installed independently of a speaker or camera and during or after the build-out of a wall.

Another object of the present invention is to provide a mounting assembly which adapts to the variety of wall types and thicknesses to provide a recessed mounting with a flush cover plate.

A further object of the invention is to provide a mounting assembly which provides proper alignment between multiple pieces for easy and inexpensive installation.

Still another object of the invention is a mounting assembly which provides a slightly tiltable, sliding adjustment of a camera or speaker for the desired view or position relative to the wall.

Other and further advantages, embodiments, variations and the like will be apparent to those skilled in the art from the present specification taken with the accompanying drawings and appended claims.

BRIEF DESCRIPTION OF THE DRAWINGS

In the drawings, which comprise a portion of this disclosure:

FIG. 3 is an exploded perspective view of a preferred embodiment of a frame structure of the present invention providing a rough-in installation mounting for attachment to either a stud or a brick wall; and FIG. 4 is a perspective view of a mounting assembly fully installed in a brick wall near a residential exterior door.

DETAILED DESCRIPTION

Figure 1:
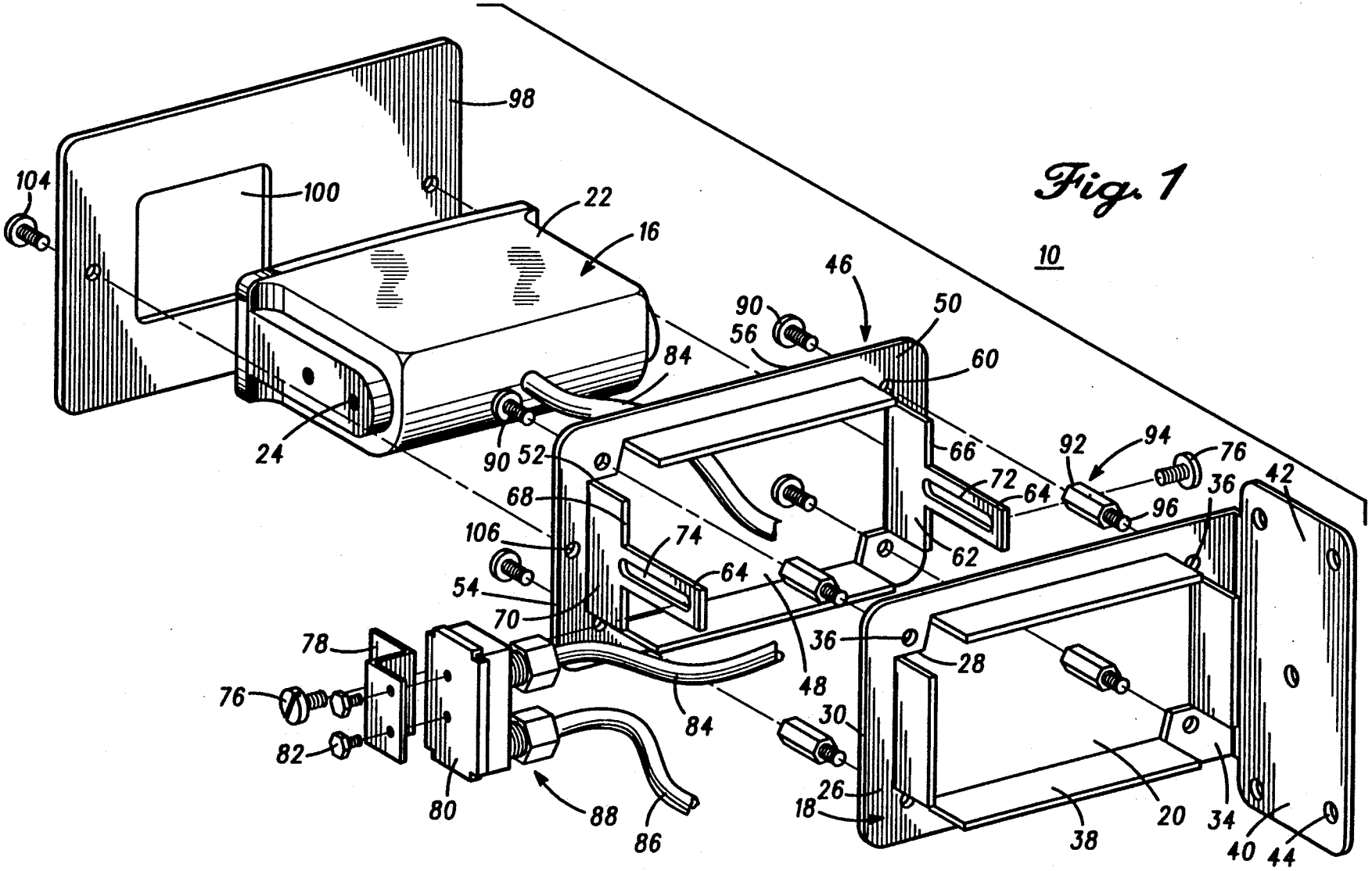
FIG. 1 is an exploded perspective view of an embodiment of the present invention illustrating a mounting assembly for a camera.

Referring to the drawings, there is seen in FIGS. 1 and 4 a first embodiment of the present invention illustrating a camera mounting assembly 10 that is in association with a wall 12 in regions thereof that are laterally adjacent to an aperture 14 that is preformed in the wall 12. A camera 16 which is mounted in the mounting assembly 10 is recessed into the wall 12 through the aperture 14 as shown, for example in FIG. 4. The wall 12 need have no special composition.

Mounting assembly 10 incorporates a one-piece, unitary frame body 18 which is preferably comprised of sheet metal. The body 18 has an open central region 20 or aperture which is adapted to receive therethrough portions of the camera housing 22. The housing 22 includes a viewing lens of the camera (not shown) and threaded screw holes 24 as means for securing the camera 16.

As those in the art will appreciate, the assembly 10 can be adapted and configured for usage with a wide variety of different camera housings. Although a camera with a cross-sectionally rectangular shape is illustrated, other camera shapes can be utilized. Also, a single camera assembly can involve two or more associated lens, each one of which is adapted to view a particular field or direction.

The body 18 has a flattened perimeter region 26 which extends about the open region 20 with an inner perimeter edge 28 and an outer perimeter edge 30. The perimeter region 26 has a front side 32 and a back side 34.

The perimeter region 26 has a plurality of apertures 36 defined therein which extend transversely therethrough. The individual apertures 36 are located substantially in the perimeter region 26 at periodically spaced intervals (preferably equal) that are located about, and are adjacent to, the open region 20. The perimeter region 26 is preferably more wide in the areas of the apertures 36 to provide reinforcement of the body 18 in those areas. The number of apertures 36 is preferably four, but more or less apertures can be used if desired.

The body 18 has a shoulder region 38 that upstands rearwardly from the inner perimeter edge 28 of the perimeter region and extends peripherally about the open region 20. Although the shoulder region 38 extends around a substantial portion of the open region 20, the shoulder region 38 is illustrated in discrete portions. The shoulder region 38 extends between the areas surrounding the apertures 36 and assists in reinforcing the body 18 against deflection either during the installation or securing the camera.

The body 18 includes a mounting flange 40 that upstands rearwardly in a perpendicular direction from one side of the outer perimeter edge 30 of the perimeter region. The mounting flange 40 has a generally flat face 42 for abutting a stud, cross-member, or other reinforcing member (not shown) extending in a perpendicular direction from the wall 12. There is at least one aperture 44 extending through the mounting flange 40 to engage a fastener attaching the body 18 to the wall stud.

The assembly 10 includes a mounting bracket 46 for the housing 22 having an open central region 48 for receiving therethrough and attaching to the camera housing 22. The mounting bracket 46 has a flattened perimeter region 50 which extends about the open region 48 with an inner perimeter edge 52 and an outer perimeter edge 54. The bracket perimeter region 50 has a front side 56 and a back side 58.

The bracket perimeter region 50 has a plurality of bracket apertures 60 defined therein which extend transversely therethrough. The individual bracket apertures 60 are located substantially in the bracket perimeter region 50 at periodically spaced intervals (preferably equal) that are located about, and are adjacent to, the bracket open region 48. The bracket perimeter region 50 is preferably more wide in the areas of the apertures 60 to provide reinforcement of the mounting bracket 46 in those areas. The number of apertures 60 is preferably four, but more or less apertures can be used if desired.

The mounting bracket 46 has a shoulder region 62 that upstands rearwardly from the inner perimeter edge 52 of the bracket perimeter region and extends peripherally about the open region 48. Although the bracket shoulder region 62 extends around a substantial portion of the open region 48, it is partitioned in discrete portions. The bracket shoulder region 62 extends between the areas surrounding the bracket apertures 60 and assists in reinforcing the mounting bracket 46 against deflection either during its installation or securing of the camera 16.

The mounting bracket 46 includes a pair of flanges 64 for mounting the camera housing 22. The flanges 64 upstand rearwardly in a perpendicular direction from one side of the inner perimeter edge 52 of the bracket. Preferably, the flanges 64 are integrally formed with the distal ends 66 and 68 of opposed shoulder regions 62 and 70, respectively.

Each flange 64 has a generally flat face 72 for abutting the camera housing 22. There is at least one aperture, preferably like the illustrated slot 74, which extends through each flange 64 corresponding in position to the threaded fastener holes 24 in the camera housing. The slot screws 76 or other suitable fasteners extend through the slot 74 engaging the camera housing 22. The shape of the slot 74 provides flexibility in adjusting the tilt and depth position of the camera 16 as it is secured to the mounting bracket 46.

The slot screw 76 also provides for attaching a bracket 78 mounting a cable adaptor assembly 80 with screws 82. The audio and video output from the camera 16 is carried by a signal cable 84 which plugs into the adaptor assembly 80 at a terminal strip 88. A coaxial cable 86 provides connection between the terminal strip 88 and a distribution device (not shown) to provide a pathway for the video signal. A shielded cable (not shown) incorporating two twisted pair wires therein connects to the terminal strip 88. One pair of wires provides operating power for the camera 16 from the signal distribution device. The other pair of wires provides a connection for the audio signal from the camera 16 to the signal distribution device.

The bracket apertures 60 are located so as to be alignable with the body apertures 36 positioned in the perimeter region 26 of the body. Thus, the mounting bracket 46 is mounted to the body 18 by aligning bracket apertures 60 with the body apertures 36 and extending fasteners, like screws 90, through each bracket aperture 60 for threadable engagement with the corresponding body aperture 36. The mounting is complete as the back side 58 of the bracket perimeter region abuts the front side 32 of the body perimeter region.

The assembly 10 can optionally include means for spacing the mounting bracket 46 from the body 18 to accommodate a variety of wall thicknesses or construction materials like plasterboard, brick, stucco and the like. A plurality of threaded spacers 92 are illustrated wherein each spacer 92 has a threaded female end 94 for engaging the threaded screws 90. Each spacer 92 also has a threaded male end 96 for engaging the body apertures 36. As can be appreciated by those skilled in the art that any one-piece or multiple piece spacer can be adapted to abut the back face 58 of the mounting bracket and the front side 32 of the body.

When the mounting bracket 46 has been thus mounted to the body 18 in a wall 12, whether or not a camera 16 is mounted to the mounting bracket 46, an optional but preferred cover plate 98 is provided which inserts over the mounting bracket 46 and body 18. For example, in FIG. 4, the cover plate 98 provides a finished metallic trim for an aesthetically pleasing flush mount to the wall 12. The present invention contemplates various finishes to complement the construction material of the wall 12. The cover plate 98 has an aperture 100 for the camera lens to view through. Optionally, an inset can be used in the aperture 100 made of glass or plastic which is transparent for the camera lens to view therethrough. An auxiliary device, such as a doorbell 102, can be conveniently mounted through the cover plate 98.

Referring to FIG. 1, the cover plate 98 is attached to the mounting bracket 46 with a plurality of screws 104 inserted into corresponding holes 106. If desired, the invention allows for mounting the bracket 46 and body 18 to a wall 12 and covering them for aesthetic reasons with the cover plate 98 even though no camera 16 is yet been mounted on the mounting bracket 46. Other means suitable for disengagedly attaching the cover plate 98 are contemplated by the present invention. For example, prongs could extend from the cover plate to engage the mounting bracket.

Figure 2:
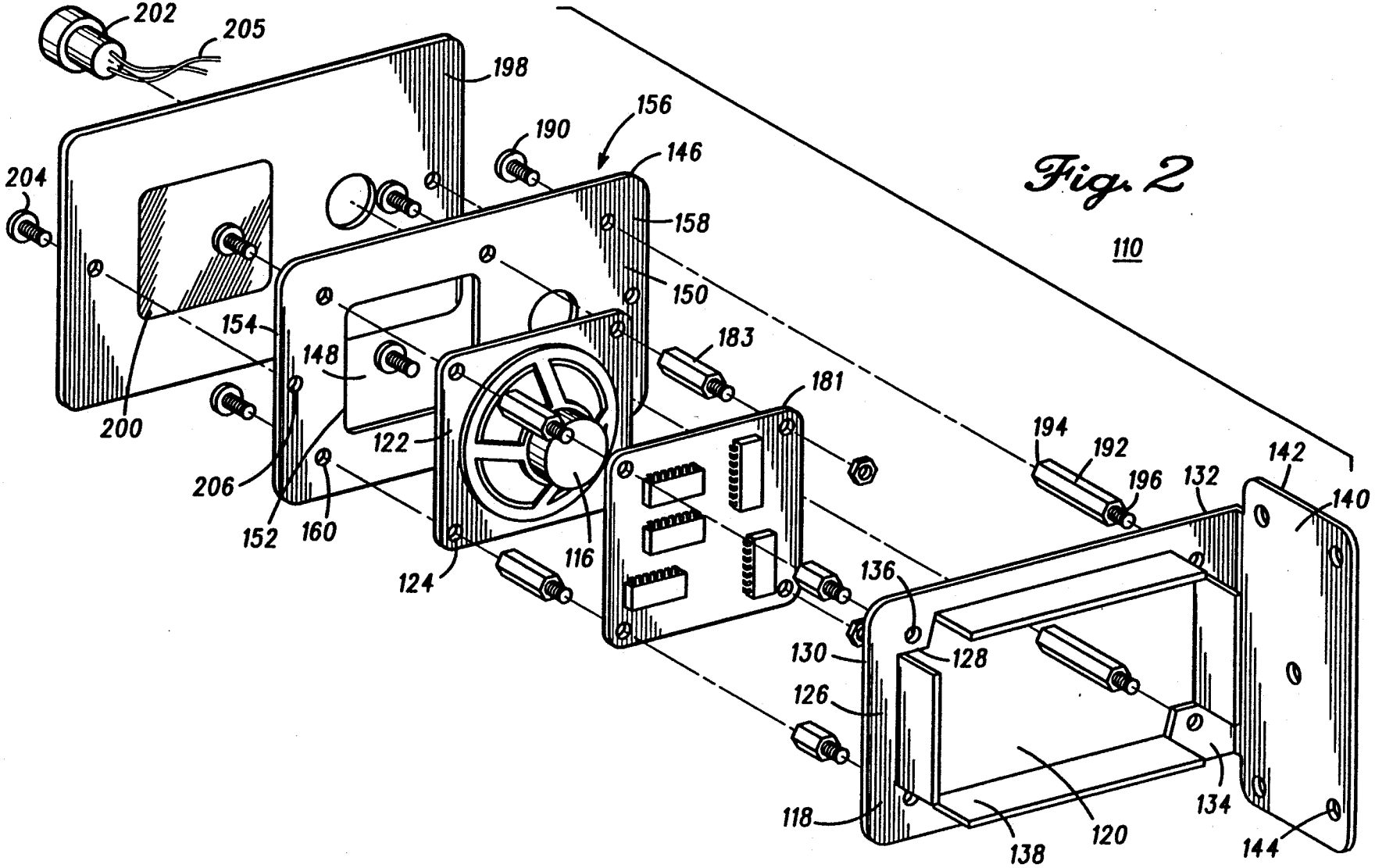
FIG. 2 is an exploded perspective view of an embodiment of the present invention illustrating a mounting assembly for a speaker and microphone.

Referring now to FIG. 2, another embodiment of the present invention illustrating a speaker mounting assembly 110 that is in association with a wall in regions thereof that are laterally adjacent to an aperture that is preformed in the wall. A speaker 116 which is mounted in the mounting assembly 110 is recessed into the wall.

The assembly 110 incorporates a one-piece, unitary frame body 118 which is preferably comprised of sheet metal. The body 118 has an open central region 120 or aperture which is adapted to receive therethrough portions of the speaker housing 122. The housing 122 includes threaded screw holes 124 as means for securing the speaker 116. Optionally, the screw holes 124 need not be threaded and simply used as clearance holes for another fastener.

As those in the art will appreciate, the assembly 110 can be adapted and configured for usage with a wide variety of different speaker housings. Although a speaker frame with a cross-sectionally rectangular shape and a circular cone is illustrated, other speaker shapes can be utilized. Also, a single speaker assembly can involve two or more associated speaker cones, each one of which is adapted for a particular frequency range (not shown).

The body 118 has a flattened perimeter region 126 which extends about the open region 120 with an inner perimeter edge 128 and an outer perimeter edge 130. The perimeter region 126 has a front side 132 and a back side 134.

The perimeter region 126 has a plurality of apertures 136 defined therein which extend transversely therethrough. The individual apertures 136 are located substantially in the perimeter region 126 at periodically spaced intervals (preferably equal) that are located about, and are adjacent to, the open region 120. The perimeter region 126 is preferably more wide in the areas of the apertures 136 to provide reinforcement of the body 118 in those areas. The number of apertures 136 is preferably four, but more or less apertures can be used if desired.

The body 118 has a shoulder region 138 that upstands rearwardly from the inner perimeter edge 128 of the perimeter region and extends peripherally about the open region 120. Although the shoulder region 138 extends around a substantial portion of the open region 120, the shoulder region 138 is illustrated in discrete portions. The shoulder region 138 extends between the areas surrounding the apertures 136 and assists in reinforcing the body 118 against deflection either during the installation or securing the speaker.

The body 118 includes a mounting flange 140 that upstands rearwardly in a perpendicular direction from one side of the outer perimeter edge 130 of the perimeter region. The mounting flange 140 has a generally flat face 142 for abutting a stud, cross-member, or other reinforcing member (not shown) extending in a perpendicular direction from the wall. There is at least one aperture 144 extending through the mounting flange 140 to engage a fastener attaching the body 118 to the wall stud.

The assembly 110 includes a mounting bracket 146 having an open central region 148 for receiving therethrough and attaching to the speaker housing 122. The mounting bracket 146 has a flattened perimeter region 150 which extends about the open region 148 with an inner perimeter edge 152 and an outer perimeter edge 154. The bracket perimeter region 150 has a front side 156 and a back side 158.

The bracket perimeter region 150 has a plurality of bracket apertures 160 defined therein which extend transversely therethrough. The individual bracket apertures 160 are located substantially in the bracket perimeter region 150 at periodically spaced intervals (preferably equal) that are located about, and are adjacent to, the bracket open region 148. The number of apertures 60 is preferably four, but more or less apertures can be used if desired.

The bracket apertures 160 are located so as to be alignable with the body apertures 136 positioned in the perimeter region 126 of the body. Thus, the mounting bracket 146 is mounted to the body 118 by aligning bracket apertures 160 with the body apertures 136 and extending fasteners, like screws 190, through each bracket aperture 160 for threadable engagement with the corresponding body aperture 136. The mounting is complete as the back side 158 of the bracket perimeter region abuts the front side 132 of the body perimeter region.

The assembly 110 can optionally include means for spacing the mounting bracket 146 from the body 118 to accommodate a variety of wall thicknesses or construction materials like plasterboard, brick, stucco and the like. A plurality of threaded spacers 192 are illustrated wherein each spacer 192 has a threaded female end 194 for engaging the threaded screws 190. Each spacer 192 also has a threaded male end 196 for engaging the body apertures 136. As can be appreciated by those skilled in the art that any one-piece or multiple piece spacer can be adapted to abut the back face 158 of the mounting bracket and the front side 132 of the body.

Attached to the mounting bracket 146, is a circuit board 181 upon which are mounted the electronic support for the speaker operation. The circuit board 181 is similarly spaced from the mounting bracket 146 by spacers like 183.

When the mounting bracket 146 has been thus mounted to the body 118 in a wall, whether or not a speaker 116 is mounted to the mounting bracket 146, an optional but preferred cover plate 198 is provided which inserts over the mounting bracket 146 and body 118. The cover plate 198 provides a finished metallic trim for an aesthetically pleasing flush mount to the wall. The cover plate 198 has a inset 200 made of an expanded metal or woven material over the open region 120. The present invention contemplates other materials which are suitable for allowing the acoustical vibrations from the speaker 116 to sufficiently pass through the material. A wire screen or perforated metal sheet are also suitable cover plates 198. Optionally, the entire cover plate can be perforated. Similarly, other materials such as plastic can be used to make the cover plate 198.

An auxiliary device, such as a doorbell 202, can be conveniently mounted through a second hole 203 in the cover plate 98. An electrical connection is made to the speaker circuit board 181 through wiring 205. Positioned on the circuit board 181 is a microphone (not shown).

The cover plate 198 is attached to the mounting bracket 146 with a plurality of screws 204 inserted into corresponding holes 206. If desired, the invention allows for mounting the bracket 146 and body 118 to a wall and covering them for aesthetic reasons with the cover plate 198 even though no speaker 116 is yet been mounted on the mounting bracket 146. Other means suitable for disengagedly attaching the cover plate 198 are contemplated by the present invention.

Referring now to FIG. 3, a preferred embodiment of the frame body 218 for mounting either a speaker or a camera is illustrated. The one-piece, unitary frame body 218 has an open central region 220 or aperture which is adapted to receive therethrough portions of either a speaker or camera housing.

The body 218 has a flattened perimeter region 226 which extends about the open region 220 with an inner perimeter edge 228 and an outer perimeter edge 230. The perimeter region 226 has a front side 232 and a back side 234. The front side 232 being nearly as thin as the material thickness, but providing a surface for abutting the other parts of the assembly as previously described.

The perimeter region 226 has a plurality of apertures 236 defined therein which extend transversely therethrough. The individual apertures 236 are located substantially in the perimeter region 226 at periodically spaced intervals (preferably equal) that are located about, and are adjacent to, the open region 220. The perimeter region 226 is preferably more wide in the areas of the apertures 236 to provide reinforcement of the body 218 in those areas. The number of apertures 236 is preferably four, but more or less apertures can be used if desired.

The body 218 has a shoulder region 238 that upstands rearwardly from the inner perimeter edge 228 of the perimeter region and extends peripherally about the open region 220. The shoulder region 238 extends around a substantial portion of the open region 220 in a continuous manner. The shoulder region 238 assists in reinforcing the body 218 against deflection either during the installation or securing the speaker or camera housing.

The body 218 includes a mounting flange 240 that upstands rearwardly in a perpendicular direction from one side of the outer perimeter edge 230 of the perimeter region. The mounting flange 240 is integrally formed with one portion of the shoulder region 238 extending in a parallel direction from its distal end 239. The mounting flange 240 has a generally flat face 242 for abutting a stud, cross-member, or other reinforcing member (not shown) extending in a perpendicular direction from the wall. There is at least one aperture 244 extending through the mounting flange 240 to engage a fastener attaching the body 218 to the wall stud. Preferably the aperture 244 has a slot like shape to provide for adjustment in the positioning of a fastener therethrough. The fastener having a head of sufficient sized to engage the opposite face 243 of the flange.

A second means of mounting the body 218 to a wall is also illustrated in FIG. 3. A pair of L-shaped flanges 251 attach to the shoulder region 238 with threaded screws 253 engaging corresponding holes 237. Each L-shaped flange 251 have one leg 255 thereof abutting the outer face of the shoulder region 238. The opposite leg 257 of each L-shaped flange 251 is positioned to abut the area adjacent to the aperture in the wall. The opposite leg 257 is attached to the wall with threaded screws 259. This means of securing the body 218 to the wall is particularly useful when the wall is made of brick, stucco or other masonry. In which case the threads on the screws 259 are appropriated spaced to attach to the masonry. Otherwise, an anchor (not shown) can be used for a more secure attachment into the masonry.

The frame bodies 18, 118, and 218 provide a frame structure for supporting the mounting of the remainder of the respective assemblies. Such a frame structure is useable as a rough-in bracket during new construction or with retro-fit applications. It is recommended to install the frame structure about 48 to about 60 inches above the floor surface on the outer wall of a doorway application. Preferably, the frame structure is not installed in the jamb of the door.

The L-shaped flanges 251 are preferably used in applications wherein the wall is made of concrete or stucco. The L-shaped flanges 251 are covered by stucco or spackle after installation, so the cover plate need not cover them.

The present invention contemplates using a variety of cameras and speakers as discussed above. A preferred camera, however, is sold by the Sony Corporation catalog no. SSC-520AM CCD monochrome camera.

Although the above description of the embodiments of the present invention have contemplated using metal as a material, other materials are also suitable. Each of the components described above could be made of a rigid plastic molded to the desired configuration. A preferred plastic is a reinforced thermoplastic.

While particular embodiments and applications of the present invention have been illustrated and described, it is to be understood that the invention is not limited to the precise construction and compositions disclosed herein and that various modifications, changes, and variations which will be apparent to those skilled in the art may be made in the arrangement, operation, and details of construction of the invention disclosed herein without departing from the spirit and scope of the invention as defined in the appended claims.

What is claimed is:

1. A mounting frame structure for association with a preformed aperture in a wall and for recessed mounting of a speaker or camera having a housing, the frame structure comprising.

a one-piece, unitary frame body having a front and back side, the frame body having an open central region for receiving therethrough body portions of the housing, the frame body having a flattened perimeter region extending about the open central region, the perimeter region defined by an outer and inner edge, a plurality of apertures individually located in the perimeter region at periodically spaced intervals about and adjacent to the central region;

a shoulder region upstanding rearwardly from and extending substantially about the perimeter region, the shoulder region having an outer and inner face, the inner face of the shoulder region being adjacent to the housing; said shoulder region including at least one L-shaped flange attached to the outer face of the shoulder region, one leg of each such L-shaped flange abutting the outer face of the shoulder region, the opposite leg of each such L-shaped flange perpendicularly upstanding from the outer face, the upstanding leg being positioned near the front face of the perimeter region and having means for being fastened to the wall; and a mounting flange upstanding rearwardly in a perpendicular direction from the perimeter region, the mounting flange having a generally flat shape and at least one aperture therethrough for receiving a fastener so that the mounting flange abuts and fastens to a stud or cross member of the wall.

2. The frame structure of claim 1 wherein the shoulder region extends from the inner edge of the perimeter region, the shoulder region extending between the perimeter apertures as a plurality of discrete shoulders.

3. The frame structure of claim 1 wherein the shoulder region extends from the outer edge of the perimeter region, the shoulder region extending substantially around the outer edge as a continuous shoulder.

4. The frame structure of claim 1 wherein the width of the perimeter region adjacent each of the perimeter apertures is greater than between the perimeter apertures.

5. The frame structure of claim 1 wherein a mounting bracket for the housing is provided, the mounting bracket having:

a front and back side;

an open central region for receiving therethrough body portions of the housing;

a flattened perimeter region extending about the open central region with the back side adapted for making abutting engagement with the front side of the frame body, a plurality of apertures individually located in the bracket perimeter region at periodically spaced intervals about and adjacent to the bracket central region, the apertures of the frame body and bracket perimeter region being adapted to disengagedly connect with one another so that the back side of the bracket perimeter region is mountable against the front face of the frame body perimeter region;

a shoulder region upstanding rearwardly from and extending substantially about the perimeter region, the shoulder region being adjacent to the housing; and means for securing the housing to the mounting bracket at the desired angle.

6. The frame structure of claim 5 wherein a cover plate for the mounting bracket is provided, the cover plate substantially covering the open central region and mounting bracket, the cover plate attached to the mounting bracket with fastening means therebetween.

7. The frame structure of claim 5 wherein means for spacing the mounting bracket from the frame body is provided to accommodate a wall between the mounting bracket and the frame body, the spacing means abuttingly engaged between the front side of the frame body and the back side of the mounting bracket.

8. The frame structure of claim 5 wherein the securing means includes a pair of housing mounting flanges upstanding rearwardly in a perpendicular direction from the bracket perimeter region, each housing mounting flange having a generally flat shape and at least one aperture therethrough for receiving a fastener so that the housing mounting flange abuts and fastens to the housing.

9. The frame structure of claim 6 wherein each housing mounting flange being integrally formed with two opposed portions of the shoulder region and extending in the same plane beyond the distal edge of each opposed portion of the shoulder region.

10. The frame structure of claim 5 wherein the mounting bracket includes a second opening for receiving therethrough an auxiliary device associated with the housing.

11. A mounting assembly for association with a preformed aperture in a wall and for recessed mounting of a camera having a housing, the assembly comprising:

(A) a one-piece, unitary frame body having a front and back side, the frame body having:

(1) an open central region for receiving therethrough body portions of the housing, the frame body having a flattened perimeter region extending about the open central region, the perimeter region defined by an outer and inner edge, a plurality of apertures individually located in the perimeter region at periodically spaced intervals about and adjacent to the central region, (2) a shoulder region upstanding rearwardly from and extending substantially about the perimeter region, the shoulder region having an outer and inner face, the inner face of the shoulder region being adjacent to the housing, (3) a mounting flange upstanding rearwardly in a perpendicular direction from the perimeter region, the mounting flange having a generally flat shape and at least one aperture therethrough for receiving a fastener so that the mounting flange can abut and secure to a stud or cross-member of the wall; and (B) a mounting bracket for the housing is provided, the mounting bracket having:

(1) a front and back side, (2) an open central region for receiving therethrough body portions of the housing, (3) a flattened perimeter region extending about the open central region with the back side adapted for making abutting engagement with the front side of the frame body, a plurality of apertures individually located in the bracket perimeter region at periodically spaced intervals about and adjacent to the bracket central region, the apertures of the frame body and bracket perimeter region being adapted to disengagedly connect with one another so that the back side of the mounting bracket mounts against the front side of the frame body, (3) a shoulder region upstanding rearwardly from and extending substantially about the perimeter region, the shoulder region being adjacent to the housing, (4) a pair of housing mounting flanges upstanding rearwardly in a perpendicular direction from the bracket perimeter region so that the housing is slightly tiltable to the desired angle, each housing mounting flange having a generally flat shape and at least one aperture therethrough to engage a fastener and abut the housing.

12. The assembly of claim 11 wherein means for spacing the mounting bracket from the frame body is provided to accommodate a wall between the mounting bracket and the frame body, the spacing means abuttingly engaged between front side of the frame body and the back side of the mounting bracket.

13. The assembly of claim 11 wherein the assembly further includes a camera having a housing portion.

14. The assembly of claim 11 wherein the body shoulder region extends from the outer edge of the body perimeter region, the body shoulder region extending substantially around the outer edge as a continuous shoulder.

15. The assembly of claim 11 wherein the width of the body and bracket perimeter regions adjacent each of the perimeter apertures is greater than between the respective perimeter apertures.

16. The assembly of claim 11 wherein the mounting flange being integrally formed with a portion of the body shoulder region, the mounting flange extending in the same plane beyond the distal edge of the body shoulder region.

17. The assembly of claim 11 wherein the body shoulder region includes at least one L-shaped flange attached the outer face of the body shoulder region, one leg of each L-shaped flange abutting the outer face of the body shoulder region, the opposite leg of each L-shaped flange perpendicularly upstanding from the outer face, the upstanding leg having means for fastening to the wall, the upstanding leg being positioned near the front face of the body perimeter region.

18. The assembly of claim 11 wherein each housing mounting frame being integrally formed with two opposed portions of the bracket shoulder region and extending in the same plane beyond the distal edge of the bracket shoulder.

19. The assembly of claim 11 wherein a cable adaptor assembly is provided, the adaptor assembly attached to the mounting bracket and having a plurality of terminals, one terminal for receiving a signal cable from the housing and providing output terminals for video and audio signals from the housing, an input terminal for receiving power from an external source and providing the power to the housing through the signal cable.

20. The assembly of claim 11 wherein a cover plate for the mounting bracket is provided, the cover plate substantially covering the mounting bracket and a portion of the open central region with an aperture in the cover plate positioned over the open central region, the cover plate attached to the mounting bracket with a fastening means therebetween.

21. The assembly of claim 20 wherein the cover plate includes a second aperture therethrough to provide external access through the front of the cover plate for a auxiliary device associated to the housing.

22. The assembly of claim 21 wherein the auxiliary device is a microphone or a doorbell.

23. The assembly of claim 12 wherein the spacing means includes a fastener having a cylindrical body, one end of the cylindrical body being threaded to engage a corresponding threaded aperture, the opposite end of the cylindrical body having a threaded hole extending into the cylindrical body for receiving a correspondingly threaded fastener.

24. A mounting assembly for association with a preformed aperture in a wall and for recessed mounting of a speaker having a housing, the assembly comprising:

(A) a one-piece, unitary frame body having a front and back side, the frame body having:

(1) an open central region for receiving therethrough body portions of the housing, the frame body having a flattened perimeter region extending about the open central region, the perimeter region defined by an outer and inner edge, a plurality of apertures individually located in the perimeter region at periodically spaced intervals about and adjacent to the central region, (2) a shoulder region upstanding rearwardly from and extending substantially about the perimeter region, the shoulder region having an outer and inner face, the inner face of the shoulder region being adjacent to the housing, (3) a mounting flange upstanding rearwardly in a perpendicular direction from the perimeter region, the mounting flange having a generally flat shape and at least one aperture therethrough for receiving a fastener so that the mounting flange can abut and secure to a stud or crossmember of the wall; and (B) a mounting bracket for the housing is provided, the mounting bracket having:

(1) a front and back side, (2) an open central region for receiving therethrough body portions of the housing, (3) a flattened perimeter region extending about the open central region with the back side adapted for making abutting engagement with the front side of the frame body, a plurality of apertures individually located in the bracket perimeter region at periodically spaced intervals about and adjacent to the bracket central region, the apertures of the frame body and bracket perimeter region being adapted to disengagedly connect with one another so that the back side of the bracket perimeter region is mountable against the front face of the frame body perimeter region.

25. The assembly of claim 24 wherein a circuit board is provided, the circuit board attached to the mounting bracket and having a plurality of terminals, one terminal for receiving a signal from an auxiliary device and

26. The assembly of claim 24 wherein the assembly further includes a speaker having a housing portion.

27. The assembly of claim 24 wherein the body shoulder region extends from the outer edge of the body perimeter region, the body shoulder region extending substantially around the outer edge as a continuous shoulder.

28. The assembly of claim 24 wherein the width of the perimeter region adjacent each of the perimeter apertures is greater than between the perimeter apertures.

29. The assembly of claim 24 wherein the mounting flange being integrally formed with a portion of the shoulder region, the mounting flange extending in the same plane beyond the distal edge of the shoulder region.

30. The assembly of claim 24 wherein the shoulder region includes at least one L-shaped flange attached the outer face of the shoulder region, one leg of each L-shaped flange abutting the outer face of the shoulder region, the opposite leg of each L-shaped flange perpendicularly upstanding from the outer face, the upstanding leg having means for fastening to the wall, the upstanding leg being positioned near the front face of the perimeter region.

31. The assembly of claim 24 wherein a cover plate for the mounting bracket is provided, the cover plate substantially covering the open central region and mounting bracket, the cover plate attached to the mounting bracket with a fastening means therebetween.

32. The assembly of claim 31 wherein the cover plate includes an aperture therethrough to provide external access through the front of the cover plate for a auxiliary device associated to the housing.

33. The assembly of claim 32 wherein the auxiliary device is a microphone or a doorbell.

34. The assembly of claim 24 wherein means for spacing the mounting bracket from the frame body is provided to accommodate a wall between the mounting bracket and the frame body, the spacing means abuttingly engaged between front side of the frame body and the back side of the mounting bracket.

35. The assembly of claim 34 wherein the spacing means includes a fastener having a cylindrical body, one end of the cylindrical body being threaded to engage a corresponding threaded aperture, the opposite end of the cylindrical body having a threaded hole extending into the cylindrical body for receiving a correspondingly threaded fastener.

36. The assembly of claim 24 wherein means for spacing the mounting bracket from the frame body is provided to accommodate a wall between the mounting bracket and the frame body, the spacing means abuttingly engaged between front side of the frame body and the back side of the mounting bracket, the spacing means also abuttingly engaged with the circuit board positioned between the back side of the mounting bracket and the front side of the frame body.

* * * * *